US005217131A

United States Patent [19]

Andrews

[11] Patent Number: 5,217,131

[45] Date of Patent: Jun. 8, 1993

[54] SHIPPING CONTAINER APPARATUS

[76] Inventor: Catherine M. L. Andrews, 3110 Highland Ave, Santa Monica, Calif. 90405

[21] Appl. No.: 910,774

[22] Filed: Jul. 8, 1992

[51] Int. Cl.[5] ..... B65D 30/00

[52] U.S. Cl. ..... 220/1.5; 206/522; 383/3

[58] Field of Search ..... 206/522; 220/1.5; 383/3; 229/DIG. 3; 190/100, 103, 104

[56] References Cited

U.S. PATENT DOCUMENTS 3,587,794 6/1971 Mattel ..... 206/522
3,889,743 6/1975 Presnick ..... 206/522
4,044,867 8/1977 Fisher ..... 206/522
4,569,082 2/1986 Ainsworth et al. ..... 206/522
4,801,213 1/1989 Frey et al. ..... 206/522

*Primary Examiner*—Joseph Man-Fu Moy
*Attorney, Agent, or Firm*—Leon Gilden

[57] ABSTRACT

A pneumatic shipping container is configured to include hook and loop fasteners to secure the upper and lower portions of the container together in assembled configuration. A modification of the invention includes the container structure formed with a rigid shell container and lid, with an inflatable liner positioned therewithin. The inflatable liner is arranged for mounting to anchor portions within the container for positioning the liner relative to the container structure.

6 Claims, 6 Drawing Sheets

SHIPPING CONTAINER APPARATUS

BACKGROUND OF THE INVENTION

1. Field of the Invention

The field of invention relates to container apparatus, and more particularly pertains to a new and improved shipping container apparatus wherein the same provides for pneumatic lining of components to be contained within a container structure to afford protection to the contents for shipping thereof.

2. Description of the Prior Art

Containers of various types, and particularly shipping containers, have been utilized in the prior art to afford protection to various components therewithin during a transport procedure. Container apparatus exemplified in the prior art is illustrated in U.S. Pat. No. 4,793,491 to Wolf, et al. setting forth a pressurizable shipping vessel for storing and transporting fluid chemicals formed of a non-metallic material.

U.S. Pat. No. 4,778,078 to McAllister sets forth an example of a vacuum insulated shipping container.

U.S. Pat. No. 4,890,764 to Rossini sets forth a stationary or mobile container for receiving toxic or dangerous substances utilizing a self-sealing wall construction.

As such, it may be appreciated that there continues to be a need for a new and improved shipping container apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of shipping container apparatus now present in the prior art, the present invention provides a shipping container apparatus wherein the same utilizes an inflatable liner construction arranged to surroundingly secure a shipping component therewithin. As such, the general purpose of the present invention, which will be described subsequently in greater detail, is to provide a new and improved shipping container apparatus which has all the advantages of the prior art shipping container apparatus and none of the disadvantages.

To attain this, the present invention provides a pneumatic shipping container configured to include hook and loop fasteners to secure the upper and lower portions of the container together is assembled configuration. A modification of the invention includes the container structure formed with a rigid shell container and lid, with an inflatable liner positioned therewithin. The inflatable liner is arranged for mounting to anchor portions within the container for positioning the liner relative to the container structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved shipping container apparatus which has all the advantages of the prior art shipping container apparatus and none of the disadvantages.

It is another object of the present invention to provide a new and improved shipping container apparatus which may be easily and efficiently manufactured and marketed.

It is a further object of the present invention to provide a new and improved shipping container apparatus which is of a durable and reliable construction.

An even further object of the present invention is to provide a new and improved shipping container apparatus which is susceptible of a low cost of manufacture with regard to both materials and labor, and which accordingly is then susceptible of low prices of sale to the consuming public, thereby making such shipping container apparatus economically available to the buying public.

Still yet another object of the present invention is to provide a new and improved shipping container apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings adn descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
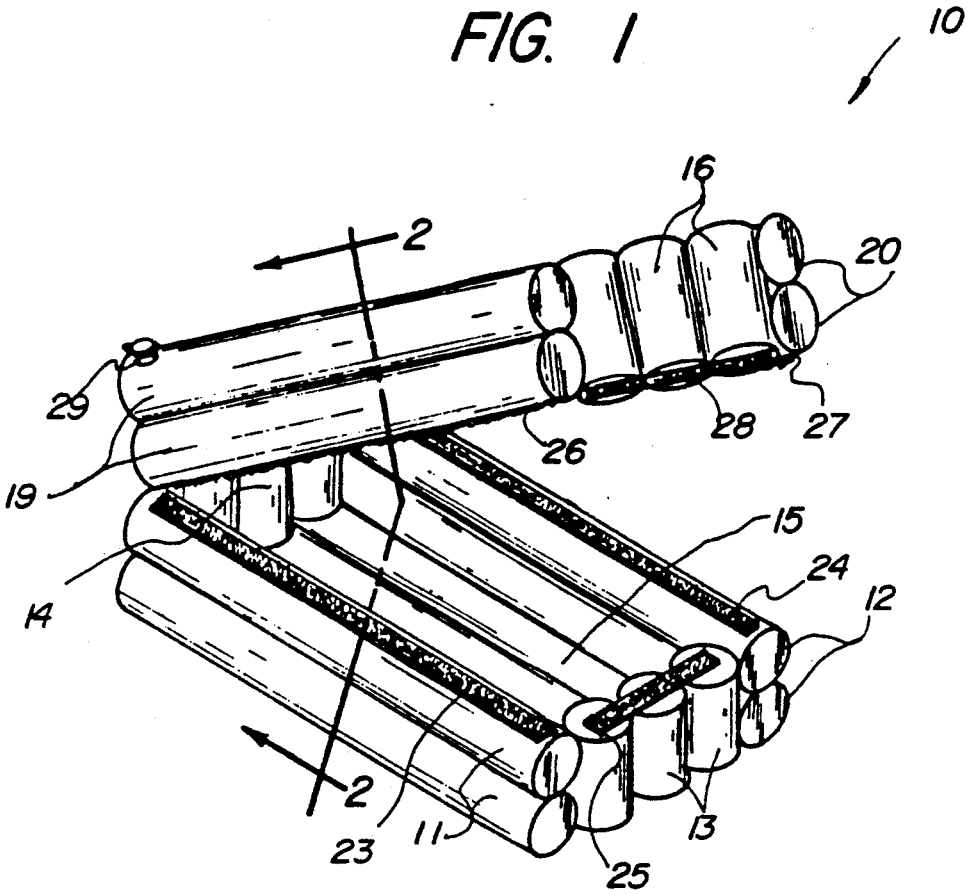
FIG. 1 is an isometric illustration of a container or liner construction of the invention.

With reference now to the drawings, and in particular to FIGS. 1 to 15 thereof, a new and improved shipping container apparatus embodying the principles and concepts of the present invention and generally designated by the reference numerals 10, 10*a*, 10*b*, and 10*c* will be described.

Figure 2:
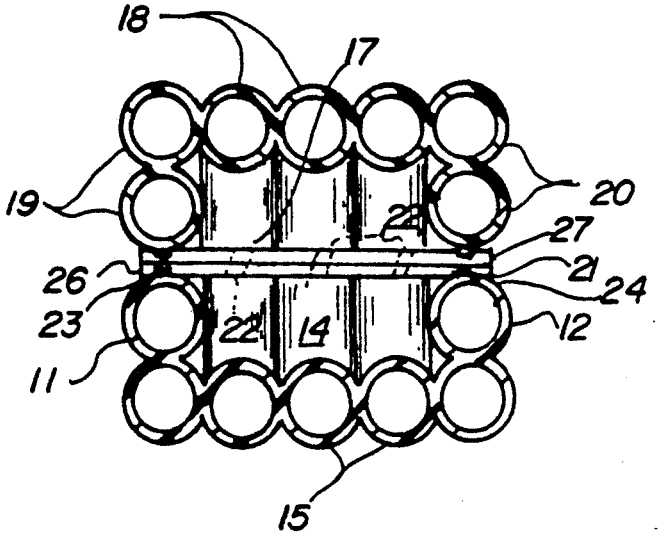
FIG. 2 is an orthographic view, taken along the lines 2—2 of FIG. 1 in the direction indicated by the arrows.

More specifically, the shipping container apparatus 10 of the instant invention essentially comprises the container structure exemplified in the FIGS. 1 and 2 to include a plurality of container pneumatic cylindrical first side walls 11 spaced from and parallel a plurality of container pneumatic cylinder second side walls 12. The use of adjacent and coextensive pneumatic cylinders are available in the front end wall construction 13, the rear end wall construction 14, as well as the container floor 15. A lid is provided hingedly mounted about a hinge 21, with the lid including a lid front wall 16, a lid rear wall 17, a lid top wall 18, a lid first side wall 19, and a lid second side wall 20, wherein each of the lid walls are arranged of pneumatic cylindrical tubes, as illustrated, to include a pneumatic inflation bladder 29 in communication with each of the wall structures of the container and lid, with the container lid cooperative relative through one another pneumatically by communication tubes 22 directed through the hinge 21. A first hook and loop fastener strip 23 is mounted to a top pneumatic cylinder of the first side wall 11, a second hook and loop fastener strip 24 mounted to upper ends of the front end wall 13, and a third hook and loop fastener strip 25 mounted to a top surface of the second side wall cylinders 12. A fourth hook and loop fastener strip 26 is mounted to a bottom surface of the lid first side wall 19, with a fifth hook and loop fastener strip 27 mounted to a bottom surface of the lid second side wall 20, and a sixth hook and loop fastener strip 28 mounted to a bottom end surface of the lid front wall 16. The first hook and loop fastener strip 23 cooperates with the fourth hook and loop fastener strip 26, the second hook and loop fastener strip 24 cooperates with the fifth hook and loop fastener strip 27, and the third hook and loop fastener strip 25 cooperates with the sixth hook and loop fastener strip 28. In this manner, the container and lid structure form an enclosure to securely receive a shipping component therewithin.

Figure 3:
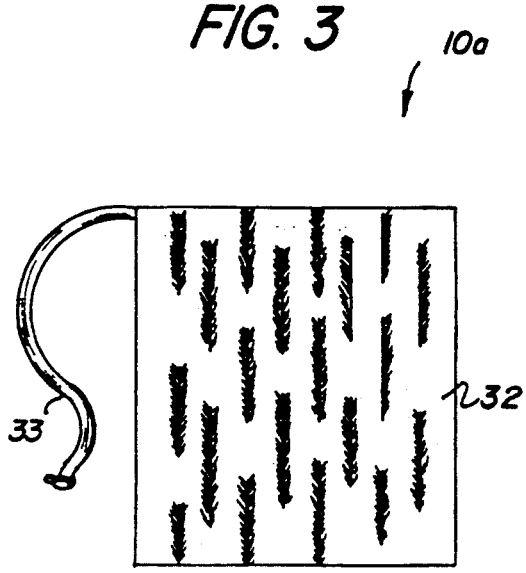
FIG. 3 is an orthographic top view of a liner construction or alternative configuration.
Figure 4:
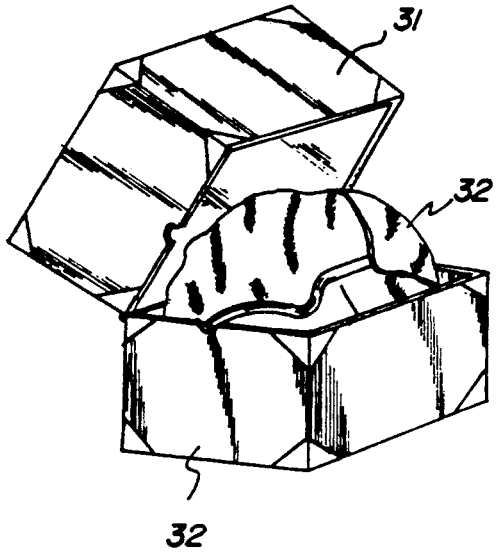
FIG. 4 illustrates the liner construction of FIG. 3 positioned within a rigid container and lid construction.

The FIG. 3 illustrates in use of apparatus 10*a* to include a rigid container 30 mounting a lid 31 thereto about a hinge member, with a lid liner 32 with an inflation liner 32 configured with an inflatable bladder tube 33 to permit selective inflation of the liner, in a manner as illustrated in FIG. 4, to surroundingly secure a shipping component therewithin.

Figure 5:
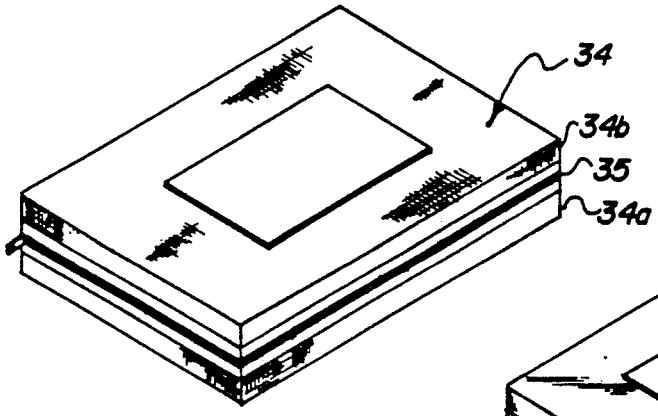
FIG. 5 is an isometric illustration of a fabric pouch to receive and position a liner therewithin.
Figure 6:
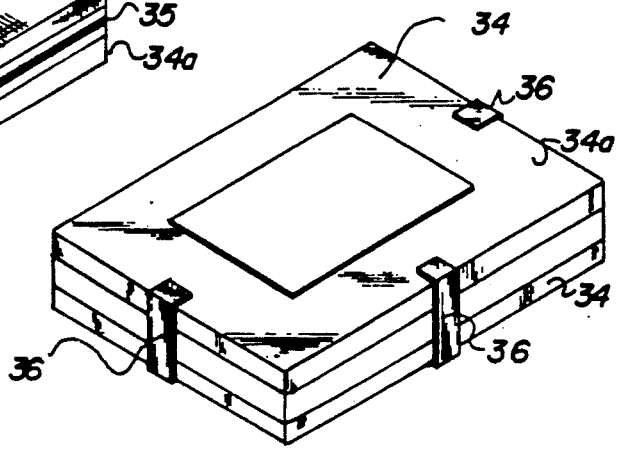
FIG. 6 is an isometric illustration of a further pouch container construction.

The FIGS. 5 and 6 illustrate a webbed pouch, such as formed of nylon and the like, including a lower container 34*a* and a lid 34*b* secured together by either a zipper construction 35 or by straps 36, as illustrated in FIGS. 5 and 6 respectively.

Figure 7:
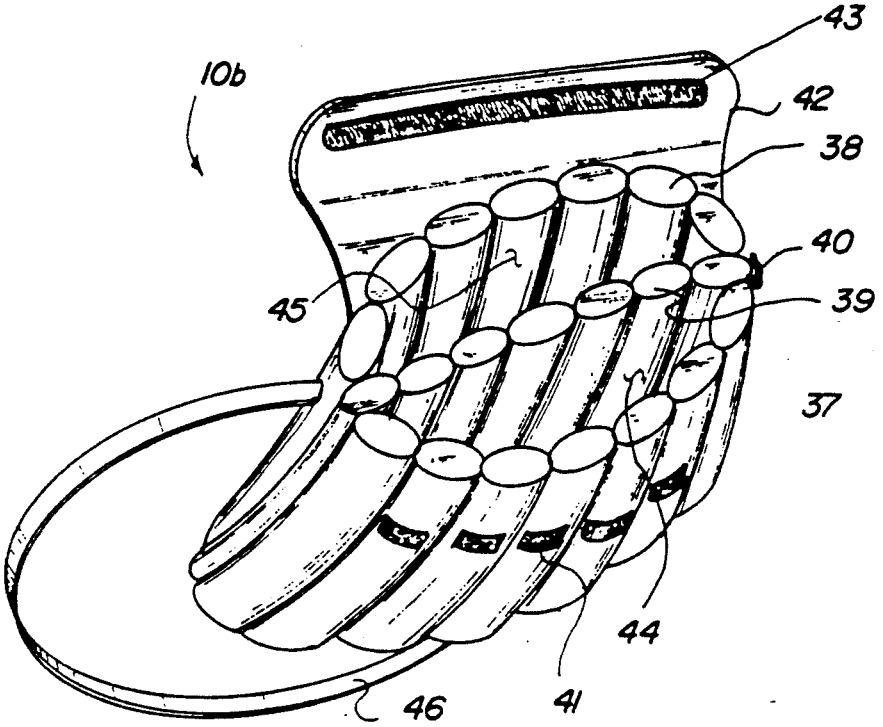
FIG. 7 is an isometric illustration of a further example utilized by the invention.

The FIG. 7 illustrates a further shipping construction 10*b*, including a first wall 37 formed of adjacent pneumatic cylinders 37, with the second wall including adjacent pneumatic cylinders 38 of the second wall and an intermediate wall 39 to define respective first and second storage cavities 44 and 45. A cover flap 42 hingedly mounted to the second wall includes a second hook and loop fastener strip 43 selectively securable in an aligned series of first all hook and loop fastener strips 41. A carrying strap 46 is arranged for securement to the second wall for ease of transport of the organization, and an inflation valve 40 mounted in pneumatic communication with the pneumatic cylinders that are in turn each in pneumatic communication relative to one another.

Figure 8:
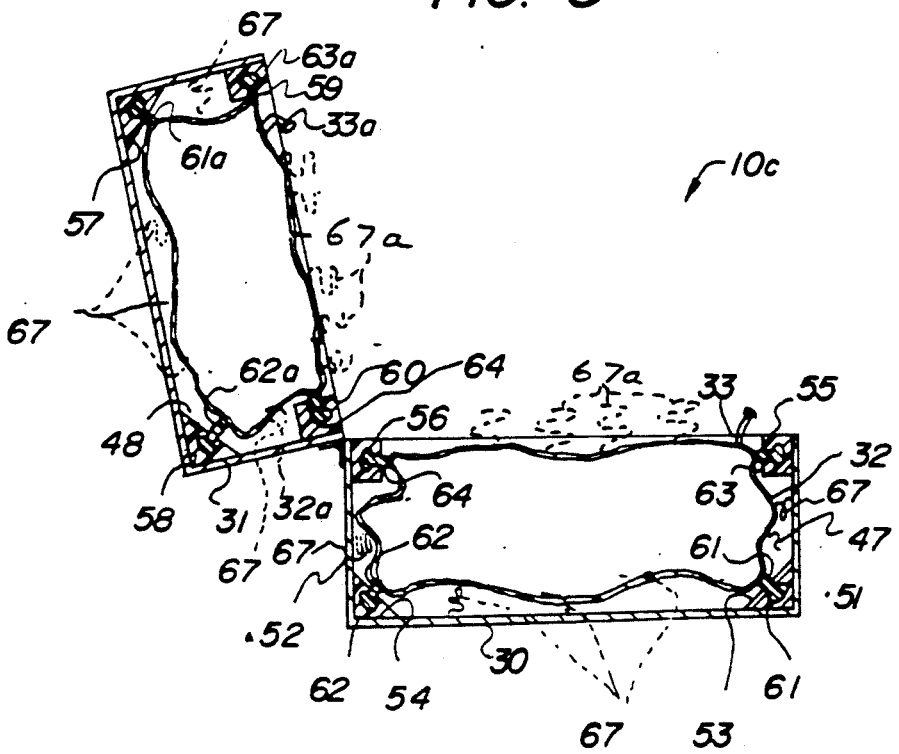
FIG. 8 is an orthographic cross-sectional illustration of the container structure of the invention utilizing anchor members to secure the liner therewithin.

FIG. 8 illustrates the rigid container and lid structure 30 and 31 of the organization 10*c* to include a container cavity 47 and a lid cavity 48. The container includes a container floor 49, with the lid including a lid roof 50. The container further including a container front wall 51 spaced from a container rear wall 52, as well as the container side walls, such as illustrated in the FIG. 4. The lid further includes the use of a lid front wall spaced from a lid rear wall, as well as lid side walls to provide for an enclosure structure when the lid is hingedly directed towards the container. Respective first and second container anchor 53 and 54 are mounted to the container floor adjacent the front and rear wall respectively, with a third and fourth anchor 55 and 56 mounted to the front and rear wall at the upper terminal end of each front and rear wall respectively. Each anchor includes an elongate generally T-shaped groove to receive a respective T-shaped rib defined by respective first, second, third, and fourth T-shaped ribs 61, 62, 63, and 64 respectively directed through the respective first through fourth anchors. Similarly, the lid includes a respective first, second, third, and fourth T-shaped rib mounted to lid liner 32*a* received within respective first, second, third, and fourth anchors 57, 58, 59, and 60 mounted to the floor and front rear walls of the lid. Each of the lid and container liners 32*a* and 32 respectively include an associated pneumatic bladder 33 and 33*a* respectively permitting selective pneumatic inflation of the container structure, such as illustrated in use of a pneumatic pump 65.

Figure 9:
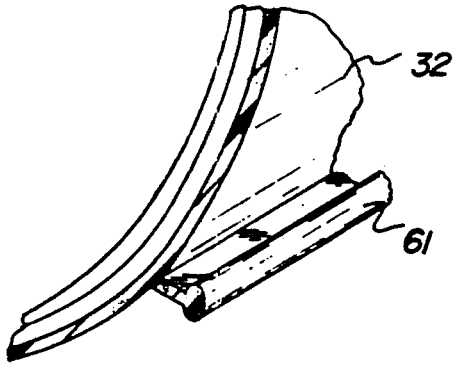
FIG. 9 is an enlarged isometric illustration of the liner construction illustrating the T-shaped rib construction for reception within the anchor portion, as set forth in FIG. 8.
Figure 10:
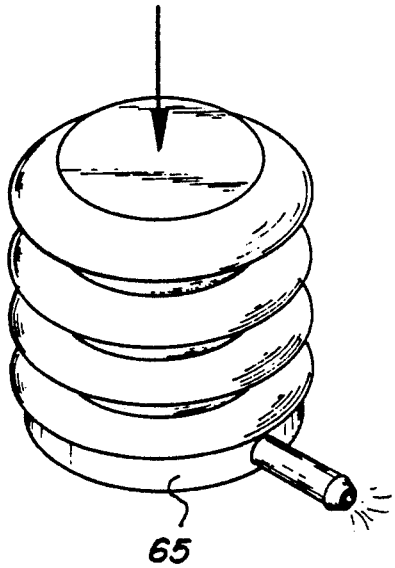
FIG. 10 is an isometric illustration of a pneumatic pump for use by the invention.

The FIG. 9 illustrates exemplary construction of the liner including an inner and outer wall, with the outer wall mounting the rib structure.

Figure 11:
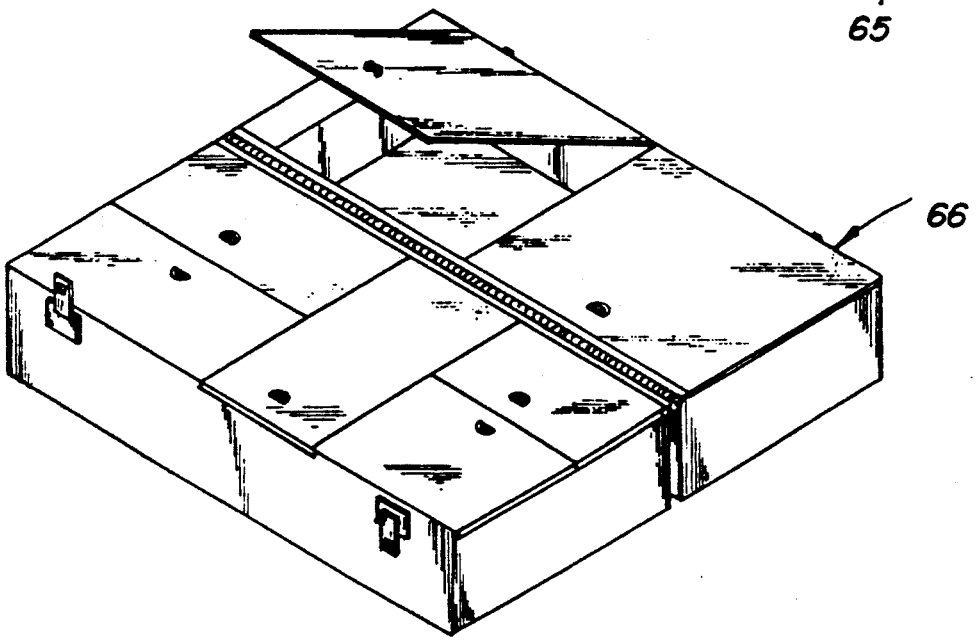
FIG. 11 is an isometric illustration of a compartmented container.

The FIG. 11 illustrates the use of the container configured with a plurality of compartments, and it should be understood that each compartment is to be configured as illustrated in FIG. 8 to include the anchoring structure to receive the T-shaped ribs 61.

It should be further noted that the container and the lid 30 and 31 respectively each include spring members 67 mounted between the respective liners and the respective front and rear walls and the floor and roof respectively of the container and the lid to further provide for cushioning of components contained within each liner.

Further, cushion springs 67*a* may be mounted to the liners of the lid and the container and to the interior surface of the liners within each liner cavity to further provide cushioning for components positioned thereon.

Figure 12:
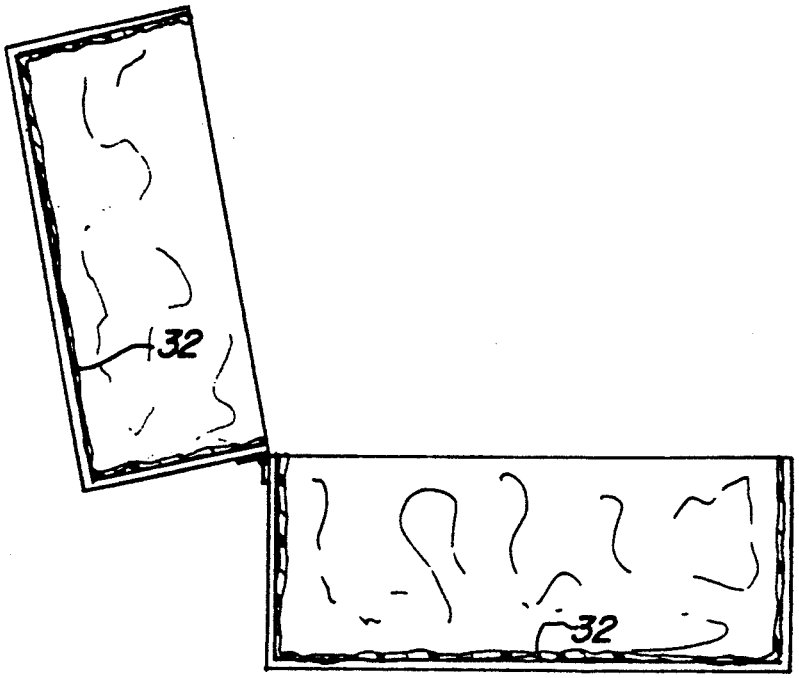
FIG. 12 is an orthographic side view of a container structure indicating the bladder member mounted coextensively to the interior surface of the container prior to inflation.

The FIG. 12 indicates the liner structure 32 mounted coextensively to the interior surface of the lid and the container as an alternative manner of mounting the liner. FIG. 12 illustrates the container structure utilizing resilient spring-like fingers 70 mounted coextensively to the container to accommodate shock and vibration as these fingers are typically of a conical configuration and formed of a polymeric type foam material, as indicated in the FIG. 15.

Figure 13:
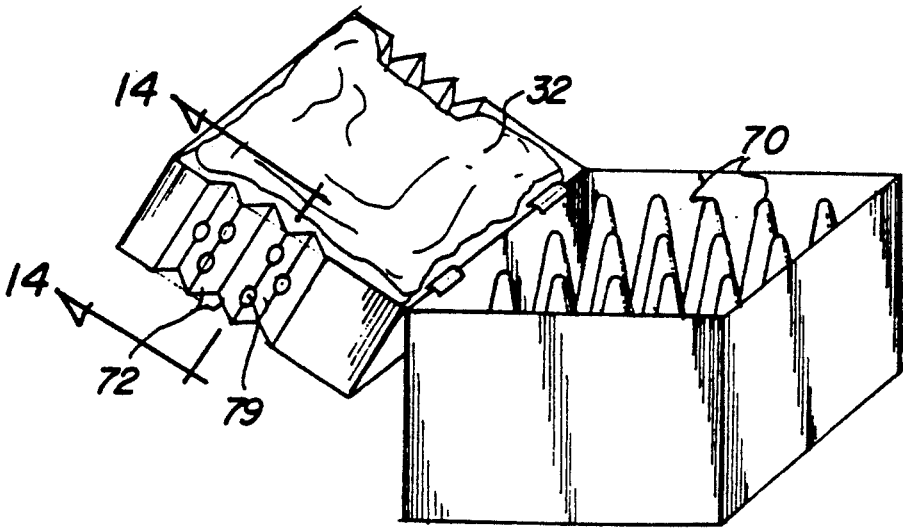
FIG. 13 is an isometric illustration of the container structure indicating the use of extensive corrugated side walls.
Figure 14:
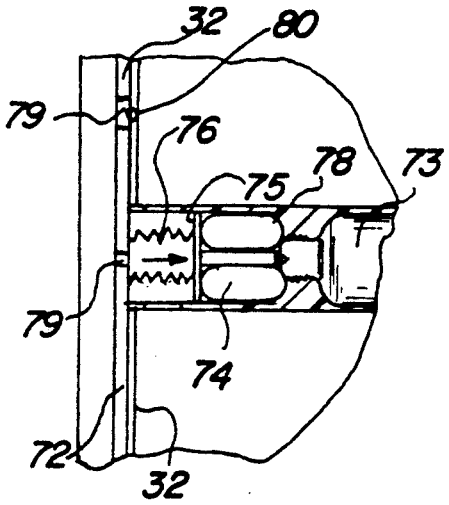
FIG. 14 is an orthographic view, taken along the line 14—14 of FIG. 13 indicating positioning of an air compensation device within the container housing.
Figure 15:
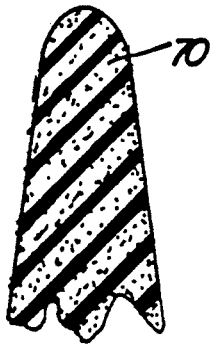
FIG. 15 is an isometric illustration of the finger-like projections mounted within the container of FIG. 13.

The liner structure of the container, as illustrated in the FIGS. 13 and 14, is mounted within the lid within the pleated portion 71 of the lid, wherein the pleats accommodate flexure of the lid as well as providing a cavity therewithin to accommodate an air compensation device to effect pneumatic inflation of the liner. The pneumatic inflation device is arranged to accommodate variations in altitude, wherein as atmospheric pressure decreases upon greater altitude, the use of a compressed gas container 73 includes a plug member 74 mounted to a plate 75 within a plug member housing 78. As a decreased atmospheric pressure is detected through the apertures 79 of the pleats 72, the spring 76 interposed between the pleats and the plate 75 effect displacement of the plug 74 relative to the container 73 to release pressure into the bladder 32 that receives the air compensation device therewithin. In this manner, increased pressurization of the bladder or liner 32 is effected. Valve 80 may also be provided in confrontation with one of the apertures 79, whereupon descent to greater pressures such as at sea level effects metered release of pressure through one of the apertures in confrontation with the check valve structure 80.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A shipping container apparatus, the shipping container including a container floor, a container front wall spaced from the container rear wall, and spaced container side walls, and a lid, the lid hingedly mounted to the container, including a lid rear wall hingedly mounted to the container rear wall, a lid front wall spaced from the lid rear wall, and spaced lid side walls, and a lid roof, and an inflatable liner mounted within the container, and an inflatable lid liner mounted within the lid, and including a first anchor mounted to the container floor adjacent the container front wall, and a second anchor mounted to the container floor adjacent the container rear wall, and a third anchor mounted to an upper edge of the container rear wall, and a fourth anchor mounted to the upper edge of the container front wall, and the container liner including a first T-shaped rib received within the first anchor, a second T-shaped rib received within the second anchor, a third T-shaped rib received within the third anchor, and a fourth T-shaped rib received within the fourth anchor, and a valve member mounted to the container liner for selective inflation of the container liner.

2. An apparatus as set forth in claim 1 wherein the lid includes a lid first anchor mounted to the lid roof adjacent the lid front wall, a lid second anchor mounted to the lid floor adjacent the lid rear wall, a lid third anchor mounted to the lid front wall spaced from the lid first anchor, and a lid fourth anchor mounted to the lid rear wall spaced from the lid second anchor, and the lid liner including a lid inflation valve mounted thereto, wherein the lid liner includes a lid pneumatic chamber for selective inflation of the lid liner, and the container liner includes a container liner chamber for selective inflation of the container liner, and the lid liner includes a lid first T-shaped rib received within the lid first anchor, a lid second T-shaped rib received within the lid second anchor, a lid third T-shaped rib received within the lid third anchor, and a lid fourth T-shaped rib received within the lid fourth anchor.

3. An apparatus as set forth in claim 2 wherein the container floor and the container front wall and the container rear wall each include at least one spring member mounted between the container liner and the container.

4. An apparatus as set forth in claim 3 wherein the lid roof, the lid front wall, and the lid rear wall each include at least one further spring member mounted between the lid and the lid liner.

5. An apparatus as set forth in claim 4 wherein the container liner includes further spring members mounted exteriorly of the container liner projecting beyond the liner.

6. An apparatus as set forth in claim 5 including an air compensation device, and the lid including a plurality of apertures, the air compensation device aligned with one of said apertures and the air compensation device includes a compressed gas canister container therewithin, and a plug member mounted relative to the compressed gas canister, and a plate mounted to the plug member spaced from the canister, and a spring member interposed between the plate and a side wall of said lid, and an aperture directed through the side wall in confrontation with said plate member, whereupon decrease in atmospheric pressure directed through said aperture effects release of said plug member relative to said canister to direct compressed gas into said liner.

* * * * *